United States Patent [19]

Smith, Jr. et al.

[11] 3,944,021

[45] Mar. 16, 1976

[54] EMERGENCY ESCAPE MECHANISM

[75] Inventors: Melvin F. Smith, Jr.; Jay Sher, both of Los Angeles, Calif.

[73] Assignees: Melvin F. Smith, Jr.; Jay Sher; Herbert Brown, ; part interest to each

[22] Filed: Feb. 18, 1975

[21] Appl. No.: 550,811

[52] U.S. Cl. ..... 182/3; 182/36; 182/82; 182/189; 187/6; 187/12; 187/27

[51] Int. Cl.[2] ..... B66B 9/00; A62B 1/02

[58] Field of Search ..... 182/82, 3–9, 182/36, 189; 187/27, 12, 6

[56] References Cited

UNITED STATES PATENTS

| | | | |
|---|---|---|---|
| 308,444 | 11/1884 | Terwilliger | 182/82 |
| 434,372 | 8/1890 | Andersen | 187/24 |
| 607,161 | 7/1898 | Conaway | 182/82 |
| 802,252 | 10/1905 | Anderson | 182/3 |
| 1,977,484 | 10/1934 | Lagerqvist | 187/24 |
| 2,270,735 | 1/1942 | Knudsen | 187/12 |
| 3,831,711 | 8/1974 | Smith | 182/82 |

*Primary Examiner*—Reinaldo P. Machado
*Attorney, Agent, or Firm*—I. Morley Drucker

[57] ABSTRACT

The invention is directed to a novel fire escape system designed for use with multi-story buildings. The system comprises a generally cylindrical (or other suitable geometric shape) vertical column, preferably attached vertically adjacent to the outside of the building, which is longitudinally slotted on one side to form a main descent channel and which has mounted within it a series of helical lead screws which are fitted together to form one continuous worm shaft.

A carrier seat (or harness) unit, which comprises, in part, a seat unit in the form of a net, a hook-up unit in the form of a ball or other suitable geometric shape, is adapted to readily engage within, and descend, at a controlled rate in, the above-mentioned apparatus.

People responding to a fire alarm will step through the leg opening in the seat unit and then place the hook-up unit of the carrier seat (or harness) unit, into the slotted channel of a feeder tube (exit lead unit) which extends from an area inside the window to the main descent channel adjacent the window.

The carrier seat unit, while carrying the person by means of the net, is then designed to slide, by gravity, through the feed tube and to the main column. The carrier unit then indexes in the main descent channel within the column and descends along the shoulders of the motor-driven rotating helical screw until it nears the bottom of the slot at which time appropriate means are provided for disembarkation. The orderly means of escape described above can be accomplished without the use of existing stairs or elevators.

17 Claims, 16 Drawing Figures

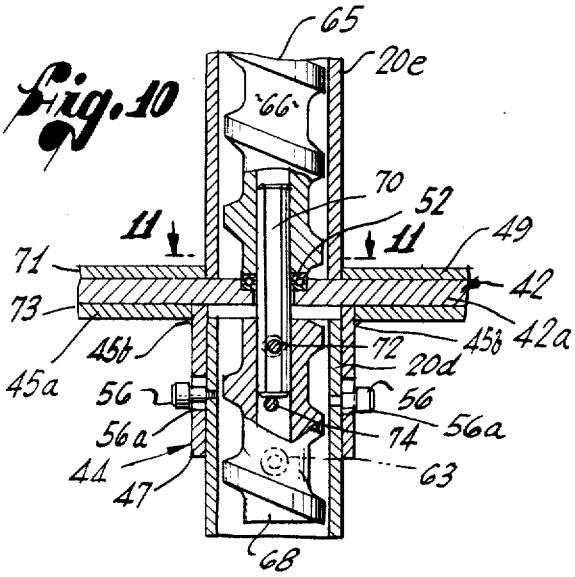
Fig. 10
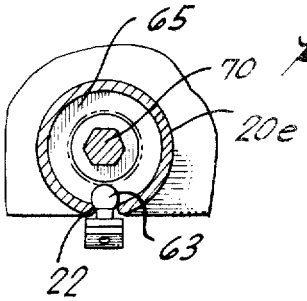
Fig. 11
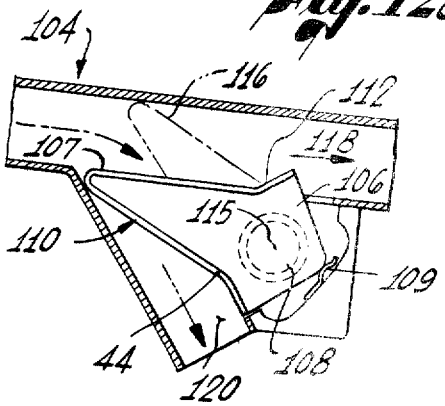
Fig. 12b
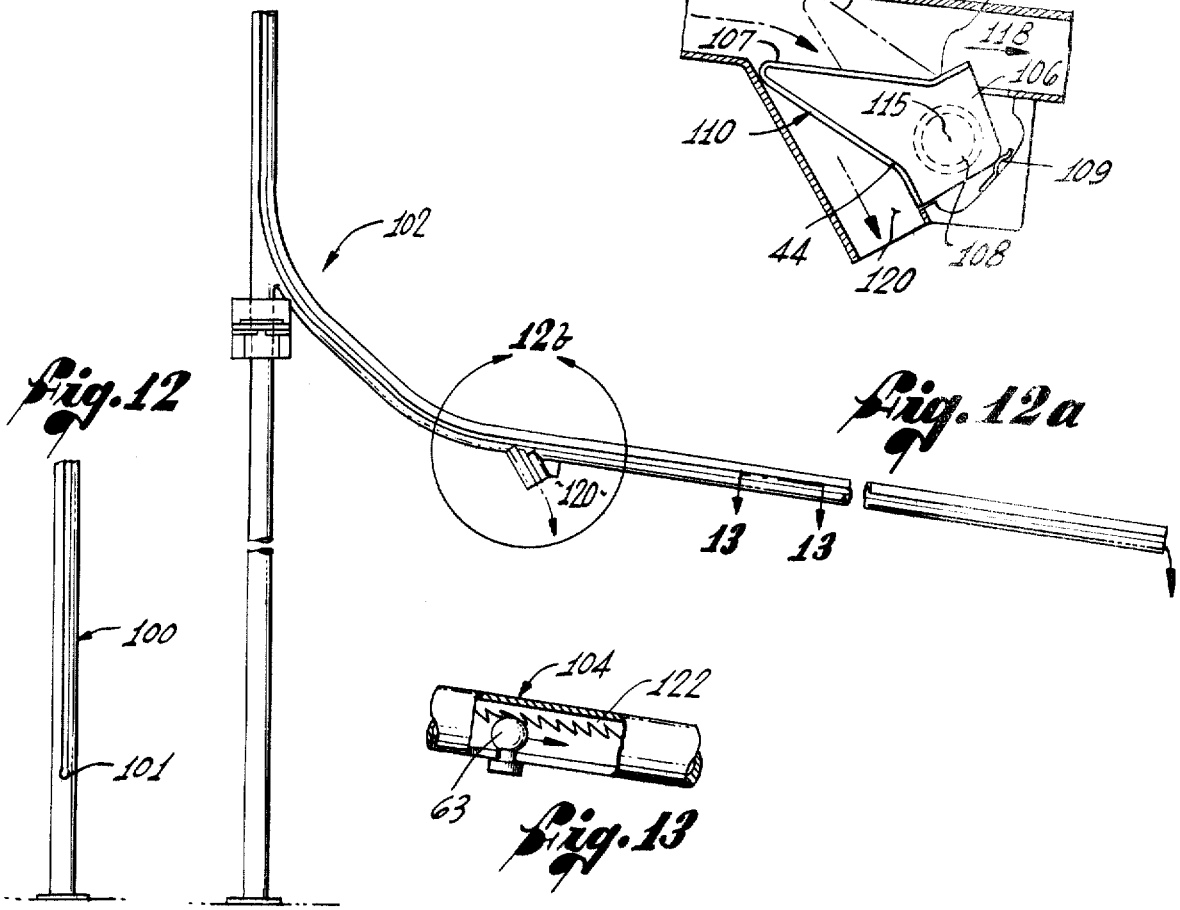
Fig. 12
Fig. 12a
Fig. 13

EMERGENCY ESCAPE MECHANISM

BACKGROUND OF THE INVENTION

Fire escape systems which are designed for use with multi-story buildings and which comprise a movable descent means located adjacent to, or within, the building, have been known for years. The present fire escape involves a novel and revolutionary approach because of a unique overall concept in which a carrier seat (or harness) unit is readily indexed within a slotted column vertically extending adjacent to the building, and descends in a controlled rate due to the controlled rotation of a helical lead screw mounted within the column.

DESCRIPTION OF THE PRIOR ART

The concept of a vertically extending descent means, located adjacent to a multi-story building, as a system for a fire escape mechanism was originated some time ago. Examples of this type of system are described in the following U.S. patents: U.S. Pat. No. 607,161, entitled "FIRE ESCAPE" issued to conaway, and U.S. Pat. No. 308,444 entitled "FIRE ESCAPE" issued to Terwilliger.

The Conaway patent discloses a fire escape system which consists of a hollow vertical column in which a zigzag slot is built into the front plate. Secured to the column, at each floor, is a pair of feeder branches which each extend upwardly and laterally therefrom to a window alongside the column. The Conaway system does not employ a rotating helical lead screw to provide the downward motion necessary for a rescue. Rather, the descending motion in the Conaway fire escape results because the escapee's weight forces the escapee to follow the course of the zigzag slot. There is no helical lead screw providing the motive force for the controlled descending motion.

The Terwilliger fire escape mechanism includes a descending plate which is provided with an attached head which is inserted into a feed slot. The plate, which is part of a channel built into the wall alongside the windows, then passes down into a zigzag slot. As in the Conaway patent, there is no helical lead screw providing the motive force for the controlled descending motion.

Thus, with respect to the Conaway and Terwilliger patents, the applicant's invention is unique because of the manner by which the downward motion of the escape means is prescribed and controlled.

Reference should now be made to other patents which deal more specifically with the concept of a controlled descending or ascending means controlled by a motor driven worm gear. The concept involved is described in the following U.S. patents: U.S. Pat. No. 2,207,544 entitled "STAIR ELEVATOR" which was issued to Knudsen, and U.S. Pat. No. 434,372 entitled "ELEVATOR" which was issued to Andersen.

The Knudsen patent relates to a stair elevator and comprises a tubular guide extending along the stairway in which a carrier is threaded to conform to the threads of the concentric worm shaft. When the worm is rotated by the motor, the carrier moves upwardly or downwardly, in a linear fashion, along the interior of the tube. The linear motion in the Knudsen apparatus is obtained because the carrier is threaded upon the worm shaft and not because a ball unit travels along the shoulders of a vertically extending lead screw.

The Andersen patent discloses a platform carrying means affixed to a ring-mounted ball assembly which assembly rides along the shoulders of a motor-driven worm gear to cause descent or ascent of the platform. The proposed invention is distinguishable from Andersen in that the applicant's carrier seat unit is not embraced by an integral concentric ring and is not providing the function of raising and lowering a platform but, rather, provides a direct means of carrying a person to rescue by means of a net-like seat unit.

The proposed automated fire escape mechanism presents a unique combination of a vertically disposed column, together with a worm shaft, located therewithin, for providing the rotative motion necessary to enable the descent motion of the escape means.

The invention has the ability to load a minimum of eight people in 1 minute, per floor, and avoids the "people stacking" problem present during embarkation in conventional fire escapes and smoke towers. The invention maintains a maximum propensity to avoid aggravating what is an already distressed atmosphere, and will safely and quickly transport large numbers of people to safety. Thus, the invention can be used as a replacement for conventional outdoor fire escapes or as a secondary system in buildings that use smoke towers as a means of fire protection.

BRIEF DESCRIPTION OF THE DRAWINGS

FIG. 10 is an axial, longitudinal, cross-sectional view, taken along line 10—10 of FIG. 8, showing the details of the manner in which adjacent sections of lead screws are fastened by a coupling shaft;

FIG. 11 is cross-sectional view, taken along line 11—11 of FIG. 10, which illustrates, in particular the seating of the hook-up unit, within the descent channel, and its relationship to the main support bracket and coupling shaft;

FIG. 12 is an elevational view of the lower section of the main column illustrating the standard disembarkation point;

FIG. 12*a* is a perspective view of the alternative embodiment of the invention, in which the manner of disembarkation has been varied; and FIG. 12*b* is an enlargement of the area indicated in FIG. 12*a*, which shows the details of the disembarkation switching arrangement for the said alternative embodiment.

FIG. 13 is a transverse cross-sectional view, taken along line 13—13 of FIG. 12*a*, showing a plan view of an optional braking buffer, in contact with the hook-up unit, for use in the alternative embodiment of the invention.

SUMMARY OF THE INVENTION

Figure 1:
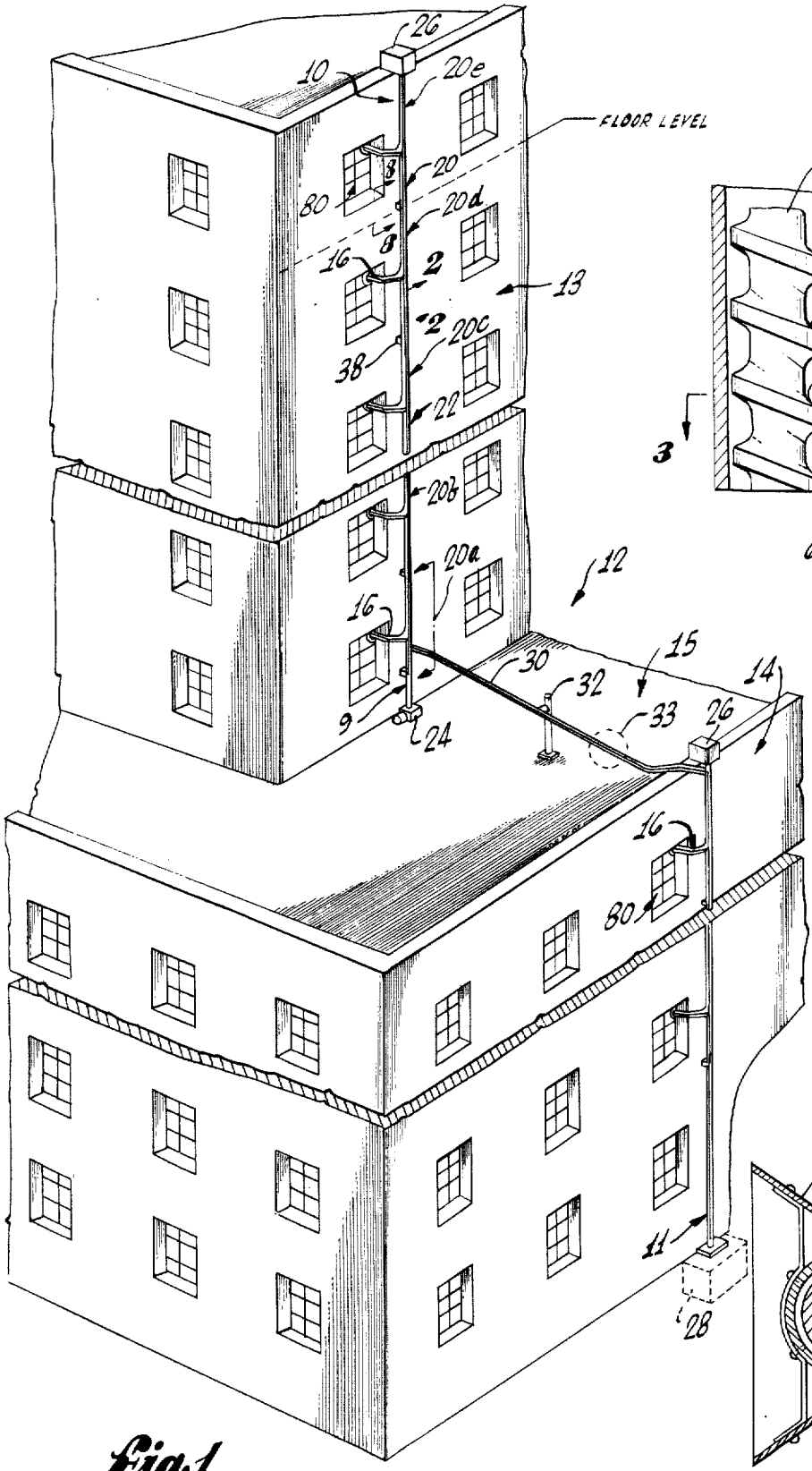
FIG. 1 is a perspective view of the fire escape mechanism installed adjacent to a multi-story "sky scraper" building consisting of stepped structures; widely employed in modern skyscraper architecture.

The present invention relates to an automated fire escape system which is designed to be installed on, or within, multi-story buildings. The relative simplicity of construction and operation of the system enables it to efficiently expedite the rescue of large numbers of people, while requiring a minimum of system maintenance.

The fire escape mechanism comprises a series of modular sections, of either cylindrical or other suitably shaped pipes, which are mounted to each other, end to end, to form a generally cylindrical column (outer casing). The column is preferably mounted vertically adjacent the outside of the building and is attached thereto, for example, by a welded major building bracket assembly mounted at the center of each floor. Each section of the column is additionally supported by a main support bracket and an alignment bracket, both of which are attached to the major building support bracket. As an alternative to outdoor placement, the main column may be placed within a shaft opening in the interior of the building.

Each section of the column, is slotted on one side along a line parallel to the longitudinal axis of the column. A continuous vertical slot or guide slot assembly, can be thereby formed in the column when the slots are aligned vertically. The aligned slots will be hereinafter referred to as "the main descent channel". The main descent channel normally from the top of the building to a point near the ground.

Secured to the main column between each floor, is a feeder tube or exit lead unit which extends laterally and slightly upwardly from the main column to the window adjacent the column. The feeder tube is slotted along one side and the feed slot is adapted to merge with the main descent channel. The exit lead unit has the function of guiding the descent escape means, i.e., the carrier seat unit, onto the main descent channel within the column. The descent escape means then continues to the bottom of the descent channel.

Mounted within the main column is a series of modular helical lead screws; one lead screw section is contained within each column section. The lead screws are axially connected to each other, adjacent to the center of each floor, by coupling shafts, each of which are used to attach the lower end of each lead screw section to the upper end of an adjacent lower lead screw section. Thus, the lead screws form one continuous worm shaft along approximately the entire length of the column.

The above-described apparatus is adapted for use with a carrier seat unit. The carrier seat or harness unit, (sometimes hereinafter referred to as the carrier seat unit) consists of the following: a hook-up unit (carrier means) comprising a generally spherical ball (or other suitable geometric shape) unit attached to a handle which is, optionally, spring-loaded and an escapee support, or seat, unit consisting of a net-like bag containing leg openings for the potential fire victim.

The carrier seat unit is designed to slide through the feed tube, by gravity, from an area inside the window to the main column. Once the seat unit indexes into the main descent channel, it is adapted to slide along the shoulders of the rotating worm shaft. The descending motion of carrier seat unit is controlled by the rotation of the worm shaft which motion, in turn, is prescribed by one or more electric motors in combination with a gear box/clutch assembly. One electric motor is preferably located at the base of the building and if additional power is required, provision can be made for location of auxilliary motors on the roof of the building or at any other required floors.

The fire escape mechanism, as described above, thus actually consists of a series of units which are complete within themselves. Each unit consists generally of a pipe column section, a lead screw, a major building bracket, a main support bracket assembly (including a radial thrust bearing), an alignment bracket, a coupling shaft, and possibly a motor. The units are interchangeable with each other and are designed to accept the sway, expansion, or contraction of the building.

During operation of the proposed fire escape mechanism, the overall method of escape will occur in the following manner. A horn or whistle will sound, in response to a fire alarm, temperature, or smoke responsive signal indicator, and the location of the nearest escape unit area will be indicated by a flashing light. The escape exit area would require a large-enough space to contain a storage compartment for the folded carrier seat unit packages and an area for the hook-up point of the exit lead unit. The storage compartment would be situated, preferably, in such a manner so as to provide a baffling effect, in the escape area, in order to prevent the stacking of people (or to prevent a draft which might feed the fire) that has often occurred during other fires. The storage compartment doors and the outside exit doors can be designed to be automatically or manually opened, and the motors can be switched on, upon activation of the fire escape system.

People responding to an alarm, or the fire itself, upon reaching the escape area will obtain the folded carrier seat unit package from the storage compartment. The package is made operative simply by the user stepping through the leg openings in the net bag. Next, the hook-up unit is lifted up and inserted into the slot of the overhead feed tube. (an optional compression spring is affixed to the handle of the ball hook-up unit in order to alleviate the forces exerted on the escapee during descent).

The hook-up unit of the carrier seat unit then slides along the feed tube slot in the exit lead unit and carries the escapee through an outside exit door. The carrier seat unit then automatically indexes into the main descent channel of the column and the seat unit travels downwardly along the shoulders of the rotating worm shaft. The carrier means descends at the approximate rate of, preferably, about three stories (30 feet) per minute, or more, until it reaches the bottom of the descent channel. At this time, the hook-up unit will automatically be released and appropriate means, for example, an air inflated mattress, will be provided for a comfortable and safe disembarkation at the release point.

Large buildings which have a reduced size at some intermediate level require two distinct fire escape mechanisms — one for each different sized structure. A means of disembarkation may be provided at the roof of the intermediate level so people can be removed from the inner fire escape when further descent is unnecessary. In addition, a transfer feeder line may be provided between the two fire escape mechanisms in order that people may be transferred, from the inner fire escape mechanism to the outer fire escape mechanism, without having to disembark from the first mechanism.

The main object of this invention is to provide an automated fire escape system which is designed for use with multi-story buildings and which, because of its simplicity of construction and operation, can quickly, orderly, and reliably transport large numbers of people to safety without the use of existing stairs or elevators.

DETAILED DESCRIPTION OF THE PREFERRED EMBODIMENT

Referring to FIGS. 1 to 11, in general, and to FIG. 1 in particular, the system shown includes the automated fire escape mechanism 10 of my invention as typically installed adjacent to the outside of a multi-story building 12. A series of exit lead units (feed tubes) 16 are shown extending through their respective windows or outside exit doors 80, from an area inside the said windows 18 to a generally cylindrical vertically extending column 20. As shown, the main column 20 has a continuous vertical slot or descent channel 22 formed on one side of the column 20, said channel 22 extending parallel to the longitudinal axis of the column.

FIG. 1 also shows, very schematically, the location of the electric motors which are used to provide power for the fire escape mechanism. The electric motor 24, at the base of the setback structure 13, is a primary source of power for the setback structure 13, while motor 26 is considered an auxiliary source of power, as required. The electric motor 28 is a primary source of power for the base structure 14 of the building shown. It must be noted that if the building being used was basically one rectangular structure, rather than a stepped structure with an intermediate level, only one electric motor would be required as a primary source of power and it would be preferably located at the base of the building. Additional power can be provided by locating auxiliary motors on the roof of the building or at any other required floor level. All motors could be reversed thereby enabling the transportation of people and equipment up to those floors required for a given purpose.

The fire escape mechanism 10, disclosed herein, comprises a series of units which are complete within themselves. Each unit consists ggenerally of a pipe column section, for example, section 20*d*, a lead screw section, for example, section 64, a major building support bracket 40, a main support bracket assembly 42, an alignment bracket 44, a coupling shaft 70, and possibly a motor. The units are interchangeable with each other are designed to accept the sway, expansion, or contraction of the building. The relative simplicity of construction as outlined above and detailed below, enables the fire escape mechanism 10, to efficiently expedite the rescue of large numbers of people while requiring a minimum of system maintenance.

As shown in FIG. 1, the fire escape mechanism 10 is comprised of a series of modular sections of metallic or nonmetallic pipe, 20*a* through 20*e*, wherein each section is approximately 120 inches in length. Each pipe section can be cylindrically shaped (or is of other suitable geometric shape) and has, approximately a 5 to 6 inch outside diameter. The diameter may be larger, of course, depending on structural consideration. The material used for the pipe sections, which are preferably cylindrical, should be durable and of high strength. The continuous column 20 is formed as a result of the sections of pipe being axially aligned with each other, in end to end fashion. A detailed description of the manner in which the pipe sections are supported and aligned is given further on.

The main column 20, though shown mounted adjacent to the outside of building 12 may, alternatively, be placed within any structurally reliable shaft opening in the interior of the building.

Though not shown in the drawings, the main column may, in certain instances, be affixed to a corner of a multi-story rather than to one side thereof.

Figure 8:
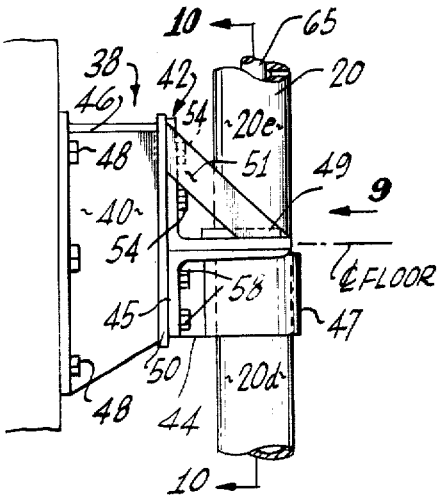
FIG. 8 is a side elevational view of the column support system showing the main column being supported by the major building support bracket, the main support bracket, and the alignment bracket.
Figure 9:
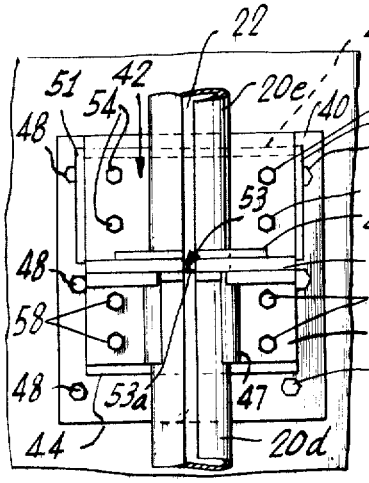
FIG. 9 is a front elevational view of the column support system shown in FIG. 8.

FIGS. 8 and 9 show a portion of a lower pipe section 20*d* and a portion of an upper pipe section 20*e*. As it can be seen, each section of pipe, and thereby the main column 20 itself, is slotted on one side along a line which is parallel to the longitudinal axis of the column 20, continuous slot or descent channel 22 (see FIG. 1 also) being thereby formed along approximately the entire length of column 20.

Figure 3:
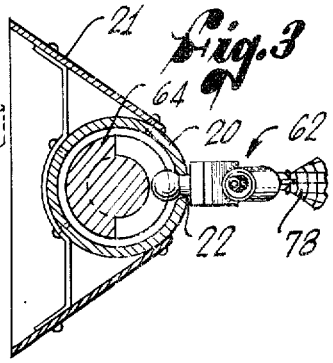
FIG. 3 is a transverse cross-sectional view, taken along the line 3—3 of FIG. 2, showing the plan view of the main column and fairing with the carrier seat unit inserted in the main descent channel.
Figure 4:
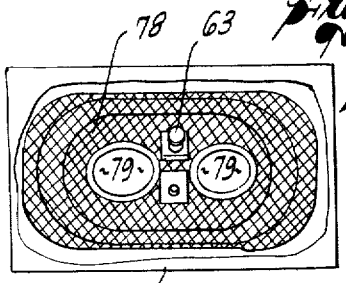
FIG. 4 is a plan view of the carrier seat unit in the folded and packaged position.

A longitudinally extending fairing means or shield 21, as illustrated in FIG. 3 is mounted on the outside of column 20 along approximately its entire length. The fairing means 21 is designed to prevent injury to the escapee, possibly incurred by wrapping his legs around any of the feed tubes 16 or support brackets 40, 42, 44 either by accident or intentionally through fear while descending in the escape means 62 (carrier seat unit). The fairing 21 can be designed, without much difficulty, to meet the aesthetic requirements desired by the architects and building owners.

The two pipe sections 20*d* and 20*e*, which are shown in FIGS. 8 and 9, and which are representative of all the pipe sections throughout column 20, are axially aligned and held rigidly with respect to each other, as are the respective slots 22*d* and 22*e*, by means of the major building bracket assembly 38. The lower end of each pipe section, for example, section 20*e*, welded to a section support base plate 49, which, in turn, is mounted to the assembly 38. In addition to the above function, the support bracket assembly 38 provides the means by which the pipe sections are mounted to the adjacent building. The support assembly 38 comprises a major building support bracket 40, a main column support bracket 42, and an alignment bracket 44. The brackets 40, 42 and 44 could be made of any suitable high strength material, such as steel.

The major building support bracket 40 is a welded assembly similar to an H-beam, with a gusset 46 across one end. The major building support bracket 40 is mounted to the center of each floor by a series of bolts 48. Mounted to the support bracket 40, on a vertically extending exterior face 50, are both the main support bracket 42 and the alignment bracket 44. Alignment bracket 44 has bolts 56 in slotted holes 56*a* in order to allow for the expansion and contraction of the building.

The main support bracket 42 is a welded or bolted assembly comprising a 90° angle with a gusset 51 on each end, a radial thrust bearing 52 (see FIG. 10) pressed into the horizontal leg 42*a* of the 90° angle member 42, wherein the angle member 42 becomes, in effect, a bearing housing, and a notch 53 in leg 42*a* which enables the hook-up unit section of the descent means 62 (described later) to move vertically past the support assembly 38. Each of the lead screw sections, for example section 20*e*, rest on the radial thrust bearing 52 and the bearing 52 provides the mechanical means by which the axially aligned, essentially contiguous, lead screw sections rotate. The thrust bearing 52 is designed to absorb stress in both the longitudinal and axial direction. The support bracket 42, as shown, is mounted to the major buiding bracket 40 by a series of bolts 54, and 54 dowels (not shown). A neoprene rubber strip or buffer 53*a* may be placed adjacent to the walls forming the notch 53 in each main support bracket 42 thereby restricting the movement of the descent means, or carrier seat unit, 62. The rubber strip acts to absorb and eliminate most of the shock experienced by the escapee in descending from one pipe section to another — for example, from section 20*e* to section 20*d*, i.e., from worm section 66 to worm section 68.

The alignment support bracket 44 is an assembly unit consisting of a 90° support angle member 45 having a horizontal position 45*a* and a cylindrical channel 47, of approximately 6 inches in length, welded thereto at 45*b* (see FIG. 10). Channel 47 supports and aligns the upper end of the pipe section, for example, section 20*d*. The pipe section 20*d*, is inserted into the channel 47 of bracket 44 and connected to channel 47 by two shoulder screws 56. A series of bolts 58 (see FIG. 9), and dowels (not shown), connect bracket 44 to the major building bracket 40.

Longitudinally extending bolts and dowels (not shown) provide the means by which the base plate 49, support bracket 42, and alignment bracket 44 are slip fit mounted to each other. Two of the bolts are common to all three of the above support means, two bolts connect bracket 42 to base plate 49, resulting in parting plane 71 (see FIG. 10), and two of the bolts connect brackets 42 and 44 resulting in parting plane 73.

Figure 2:
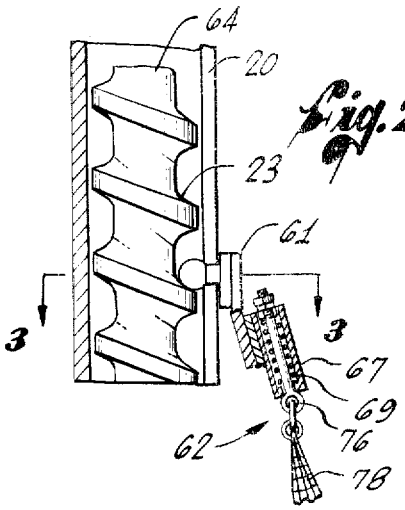
FIG. 2 is a cross-sectional view, taken along line 2—2 of FIG. 1, which shows a side elevation of a section of the main column illustrating, in particular, the hook-up unit, of the carrier seat or harness unit, seated on the worm shaft (the carrier seat or harness unit is hereinafter simply referred to as a carrier seat unit)

FIG. 2 shows a cross-sectional side elevational view of a portion of the main column 20. In this figure, a carrier sear (or harness) unit 62, which is the descent means of fire escape mechanism 10, is shown seated on the shoulder 28 of helical lead screw section 64. The lead screw section 64 shown is only one of a series of modular helical lead screws. One lead screw section is contained within each of the sections of pipe, 20*a* to 20*e*, which constitute main column 20. The lead screws form one continuous worm shaft 56 along approximately the entire length of the column 20. Each lead screw section 64 has approximately a 4 inch outside diameter, a length of approximately 120 inches, and has one thread per every 3 inches of length. The material used for the lead screw should be durable and of high strength, and should have high torque characteristics.

As can been seen in FIGS. 10 and 11, the lead screw sections, for example, sections 66 and 68, are axially aligned with each other within their respective pipe sections 20*e* and 20*d*. A chamfered coupling shaft 70 passes through bearing 52 of main support bracket 42 and is used to rigidly connect, and longitudinally align, abutting lead screw sections, for example, sections 66 and 68. The coupling shaft 70 thus provides the connection between the lower end of the lead screw section corresponding to the floor above and the upper end of the corresponding lead screw section of the floor below.

The coupling shaft 70 is mounted to the lower lead screw section, for example, section 68, by a coupler or set screw 72. The coupler 72, in conjunction with shaft 70, is designed to provide a highly reliable rigid connection between the lead screw sections so that during rotation of the worm shaft 65, upon bearings 52, the carrier seat unit 62, can be adequately supported during descent. A locater pin 74 provides a menas by shich the coupling shaft 70 can be easily located within the lead screw sections, when one of the screw sections becomes damaged or worn during use and needs replacement.

Figure 5:
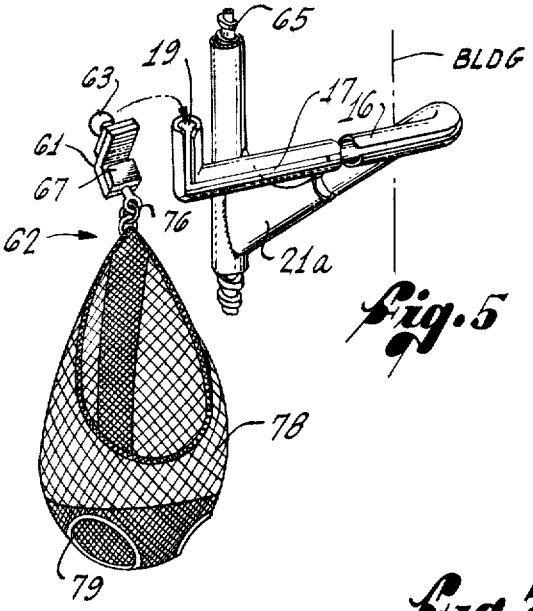
FIG. 5 is a perspective view of the carrier seat unit, in the opened position, with the hook-up point of the exit lead unit adjacent to it.

FIG. 5 shows a perspective view of the exit lead unit or feeder tube 16 attached to a typical pipe section. The exit lead unit 16 is tubular in structure and has a feeder slot 17 formed along one of its sides. The feeder slot 17 is so formed along one of its sides. The feeder slot 17 is so formed as to merge smoothly with the main descent channel 22, and its fairing 21*a*. The lead unit 16 is welded to the main column 20 above each floor, at approximately a 15°–20° angle, and extends laterally and upwardly therefrom to a window or outside exit door 80 located adjacent the column. The exit lead unit 16 is designed to guide the descent means 62 through the exit door 80 and into the main descent channel 22. The entrance section 19 of the lead unit 16 consists of a squared-off welded corner with a wedge-shaped chamfered entrance which merges with slot 17. The squared-off entrance section 19 provides protection against any intentional or inadvertent attempt to dislodge the descent means from the exit lead units 16.

Figure 2A:
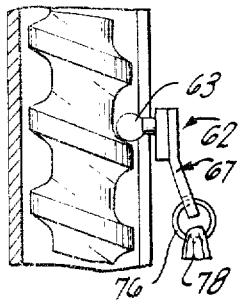
FIG. 2*a* illustrates an alternate design of the hook-up unit in which the handle is fixed in position rather than spring-loaded.

A carrier seat unit 62 is designed to function as the descent means (see FIGS. 2, 3 and 5) and is adaptable to the apparatus mentioned above. The carrier seat unit 62 consists, in part, of a hook-up unit 61 which comprises, for example, a generally spherical ball (or other suitable geometric shape) unit 63 attached to a handle 67 which can be of a fixed type (see FIG. 2*a*) or may optionally contain a compression spring 69. The spring 69 can be affixed within the handle 67, as shown in FIG. 2, in order to alleviate the forces exerted on the escapee during hook-up and descent. Attached to the handle 67 by, for example, conventional ring mounts 76, is an escapee support unit 78 (seat unit) comprising a net like bag which contains leg openings 79 for the potential fire victim. The bag may be made of a fire retardant nylon or any other material of similar qualities.

FIG. 3 shows a typical cross-sectional plan view of the carrier seat unit 62 engaged in descent channel 22 of main column 20. FIG. 11, which is a cross-sectional plan view, additionally shows the location of the coupling shaft 70 within shaft 65. Not shown is notch 53 of main support bracket 42 which is physically located, longitudinally, immediately below the channel 22 shown in FIG. 11.

Once the carrier seat unit 62 is engaged in the feeder slot 17, it slides by gravity, through the exit lead unit 16 until it indexes into the main descent channel 22.

Thereafter, the hook-up unit 63 is adapted to slide along the shoulders 23 of the rotating worm shaft 65. The rotation of the worm shaft 65 is regulated, or governed, by the electric motors 24, 26, 28, wherein electric motors 26 and 28 may be optional or auxiliary, depending on the size, requirements, and architecture of the particular building.

Each of the electric motors should, preferably, be integrally connected, along the same longitudinal axis, with a clutch assembly and a 90° gear box. All motors should have a clutch assembly in order to allow for any mis-synchronization that exists during the starting and stopping of the motors. The 90° gear box would be adapted, typically, to a spiral gear which, in turn, would mesh with worm shaft 65 to provide the motive power for the descent motion of carrier seat unit 62.

Carrier seat unit 62 thus descends at a controlled rate which is directly related to the movement of the ball unit 63 along the shoulders 23 of worm shaft 65. The motion of worm shaft 65, in turn, is prescribed and controlled by one or more electric motors. The carrier seat unit 62, while carrying a person by means of the escapee support unit 78, descends at an approximate rate, preferably, of about three stories per minute, until it nears the bottom of channel 22. Channel 22 extends from the top of the building to a point near either the ground or some intermediate level 15. At the bottom of the channel 22, appropriate means is provided for disembarkation.

As shown in FIG. 1, a transfer feeder line 30 is supported on intermediate level 15 by a typical feeder line support column 32. Because of the stepped nature of the building 10, the feeder line 30 will provide a means of connection between the inner fire escape mechanism 9 and the outer fire escape mechanism 11. This feeder line 30 will enable people using fire escape system 10 to be transferred from the inner fire escape 9 to the outer fire escape 11 without having to disengage the descent means 62 from the inner fire escape. A release point 33 can be optionally provided, at intermediate level 15, thereby enabling the removal of people from the fire escape system 10 when further descent past level 15 would be unnecessary in order to escape the fire.

Figure 6:
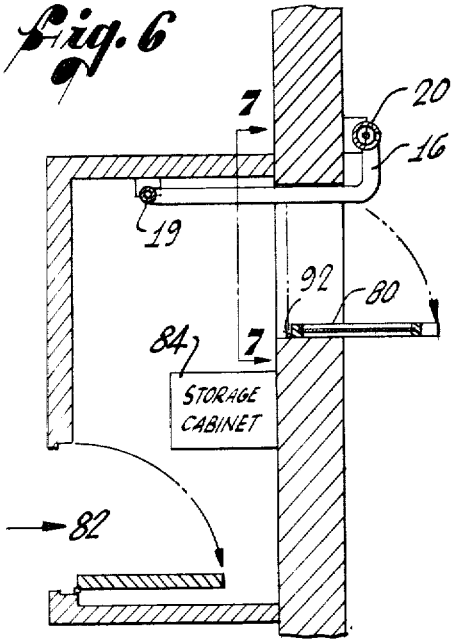
FIG. 6 is a plan view of one of many optional escape exit areas showing the storage compartment for the carrier seat packages, the outside exit door, and the exit lead unit.
Figure 7:
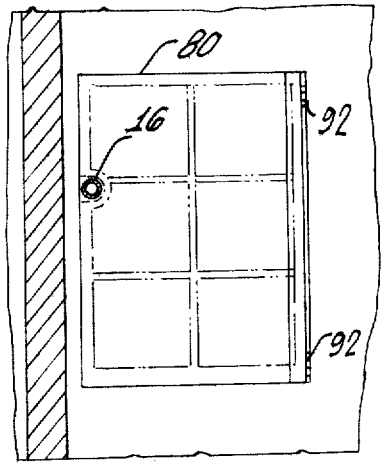
FIG. 7 is an elevational view, taken along line 7—7 of FIG. 6, showing one optional design of the structure of a typical exit door in the closed position.

FIG. 6 is a plan view of a typical escape exit area 82 showing the carrier storage compartment 84 in which the closed and packaged carrier seat packages 60 are stored. In the optional arrangement shown, the exit lead 16 is shown extending along the interior wall of the escape area 82 from an effective position at which the hook-up point 19 can be located. The outside exit door 80 is shown in the open position as if the door 80 had previously been manually or automatically opened. FIG. 7 shows, in some detail, the mounting arrangement for a typical outside exit door 80. The latching-/actuator arrangement is not shown since it is of optional design as required by the particular installation.

The exit door 80 is spring-loaded outwardly from the building as is depicted typically in FIG. 6. Exit door 80 rotates about the longitudinal axis on one of many types of conventional, or non-conventional, hinge means 92. The hinge means 92 is located along the horizontal edge of the uppermost end of the exit door another is located along the horizontal edge of the lower-most end of exit door 80. The support for hinge means 92 can be mounted to either the metal frame of the window or the concrete structure of the wall and the combination of support and hinge means 92 would be typical of that used in automatic doorways located, for example, in large department stores.

The overall employment and operation of the fire escape mechanism 10, and its accompanying systems would take place typically in the following manner. A fire occurs on, for example, the tenth floor of a multistory building and a fire alarm is activated by an occupant or automatically by a temperature or smoke responsive signal indicator. As a result, an alarm (a horn or bell, etc.) will sound, on floors 9 through 13, a flashing amber light will indicate the location of the mearest escape exit area 82. An occupant can thus find the way to the escape area 82 even if the hallways and stairwells are filled with smoke and the elevators are no longer functioning. The outside exit doors 80, and the doors to the carrier storage compartments 84, will automatically open on all floors of the building. The disembarkation landing means, for example, an air-inflatable mattress, will automatically inflate (and, optionally, the air conditioning can be minimized or shut-down in order to prevent the pumping of smoke throughout the building). Electric motors (supplied with their own power source) for example, 24, 26, 28, could also be automatically switched on.

People responding to the alarm, or the fire itself, would thus proceed to the nearest escape exit area 82. The escape exit areas 82 could be a separate room or open area but would require sufficient space to contain both the carrier storage compartment 84, for the folded carrier seat packages 60 (see FIG. 4), and an area for the exit lead unit 16 and its hook-up point 19. The escape exit area 82 could be so arranged that the placement of the storage compartment 84, with respect to hook-up point 19, would provide a baffling effect that would force the people using the area to proceed in an orderly fashion, thereby reducing the panic crush of people in the escape area 82.

The escapees will then take the folded carrier seat packages 60 from storage, step through the leg openings 79 in the net-like support unit 78, and then pull on the net until it fits securely on one's thighs. Using the handle 67 of hook-up unit 61, the ball unit 63 is then lifted overhead and inserted in the slot of entrance section 19 of exit lead unit 16. The optional compression spring 69 can aid in alleviating some of the forces exerted on the escapee during this hook-up and further descent. The fire escape system shown is presently designed to load on the order to eight people in 1 minute, per floor. It will be understood, however, that the desired load rate may be varied considerably.

The ball hook-up unit 61, of descent means 62, then slides by gravity laterally downwardly within slot 17 of feed tube 16 until it engages the main descent channel 22. As previously described above, the ball unit 63 then descends along the shoulders 23 of the rotating worm shaft 65 thereby causing the carrier seat unit 62 to descend at a rate which is controlled and governed by the use of electric motors.

As the descent means 62 nears the bottom of the main column 20, a standard drop unit 100 (see FIG. 12) is provided, with a positive stop, or release, point 101, to make the disembarkation as comfortable and efficient as possible. The release point 101 is at least 3 feet above the ground. An alternate drop unit 102 (see FIG. 12*a*) may also be provided at either the ground release point or at optional release point 33 on intermediate level 15 (See FIG. 1). Drop unit 102 can also be especially useful when the fire escape 10 is located within some structurally reliable shaft opening (for example, an elevator shaft in the building).

FIG. 12*b* is an enlargement of the area indicated in FIG. 12*a* and specifically indicates a typical moveable gate means 104 which can be employed in alternate embodiment form 102. The moveable gate means 104 comprises a gate-like toggle means or switch 106, a bolt (or shaft) 108 centrally located along the longitudinal axis of toggle means 106, and a leaf spring 109.

During operation, the ball unit 63 of descent means 62 will slide along either surface 107 or 110 of toggle switch 106. The ball unit 63 will then push on the projecting shoulder 112 or 114 located at the posterior of toggle means 106. The toggle means 106, which is tensioned in position by leaf spring 109, will then rotate about axis 115 to another predetermined position, for example, to alternate (dotted) position 116 shown in FIG. 12*b*. The descent means 62 thus alternately slides either in passageway 118 or 120, thereby enabling people to disembark at two distinct locations. The alternate means of disembarkation thus provides a reliable means by which large numbers of people can be quickly and safely disengaged from the fire escape mechanism 10.

An optional braking buffer means 122, made of rubber or similar material, may be inserted in passageway 118 or 120 (see FIG. 13) in order to retard the rate of descent of carrier seat unit 62. The braking buffer 122 will enable a smoother descent and will alleviate some of the forces exerted on the escapee just prior to, and during, disembarkation from the fire escape mechanism 10.

Because of the baffling effect present in the design of the escape exit area 82, this invention avoids the "smoke stacking" problem present during disembarkation in conventional fire escapes and smoke towers. The persistent problem of confusion caused by having firemen ascending in smoke tower stairwells which are currently locked from inside, while escapees are descending in the stairwells, is thus avoided. Thus, this invention maintains a maximum propensity to avoid aggravating what is an already distressed atmosphere. The fire escape mechanism of this invention can thus be used efficiently as a replacement system for conventional outdoor fire escapes or can be used as a secondary system in buildings currently using smoke towers as their primary means of escaping from fires.

While the fire escape mechanism 10 is shown attached to the side of a building, it may also be attached to the corner of a building by support brackets of the same or similar type to that described herein, except that the mounting is to the corner of the building. Further, other modifications, such as providing a sprinkler system for automatically wetting the fire escape mechanism during a fire may be provided. The wiring necessary for operation of the fire escape mechanism may all be external or modular, on a floor-by-floor basis. Also, structural considerations, from building to building, may require modifications in the support structure and fire escape structure, per se.

We claim:

1. An emergency escape apparatus, which comprises:

a plurality of modular column sections, each of which are axially aligned and mounted essentially contiguous to each other, to form a main column, each of said column sections having a slot along one side, said slots being maintained in a constant alignment whereby said aligned slots form a descent channel within said main column, said descent channel extending parallel to the longitudinal axis of said main column;

a plurality of modular helical lead screw sections, each of which are axially aligned and mounted, essentially contiguous, to each other, to form a worm shaft, said worm shaft being generally centrally located, and rotatable, within said main column and extending parallel to the longitudinal axis of said main column;

motive power means for rotating said worm shaft;

at least one exit lead unit extending laterally to said main column, from an area adjacent said main column, and adapted to merge with said main column, said exit lead unit being slotted longitudinally along one side to form a feeder slot merging into said descent channel;

a carrier means having a hook-up unit affixed thereto, said hook-up unit being adapted to ride within said feeder slot in said exit lead unit and, thence, ride within said descent channel in said main column, whereby as said worm shaft is rotated in the prescribed direction by said motive power means, said hook-up unit, while engaged in said descent channel, slides along the shoulders of said rotating worm shaft and thereby descends longitudinally within said descent channel, said rate of longitudinal movement of said hook-up unit thus being indirectly prescribed and governed by said motive power means; and an escapee support means connected to one end of said carrier means, said escape support means to be secured to a potential escapee, whereby as said hook-up unit descends in said descent channel, said escapee support means descends toward the bottom of said descent channel.

2. The emergency escape apparatus of claim 1 in which a plurality of major building bracket assembly means are provided for supporting and aligning said column sections and for mounting said modular column sections, and thereby said main column to a structurally reliable, adjacent, structure.

3. The emergency escape apparatus of claim 1 in which a coupling means is affixed to adjacent pairs of said lead screw sections so that during rotation of said worm shaft said lead screw sections can be supported and maintained in alignment.

4. The emergency escape apparatus of claim 1 in which said carrier means comprises, additionally, a handle means affixed to said hook-up unit whereby said hook-up unit is placed within said feeder slot of said exit lead unit.

5. The emergency escape apparatus of claim 1 wherein said hook-up unit comprises a generally spherical ball unit.

6. The emergency escape apparatus of claim 4 in which said handle means is compression spring-loaded.

7. The emergency escape apparatus of claim 1 in which said escapee support means includes a seat unit means.

8. The emergency escape apparatus of claim 7 in which said seat unit means comprises a net-like bag containing leg openings for the potential escapee.

9. The emergency escape apparatus of claim 1 in which a disembarkation means is provided, said disembarkation means including a positive stop means for said carrier means, said stop means located in said descent channel and near the bottom of said main column.

10. The emerency escape apparatus of claim 9, in which said positive stop means is located at least three feet from the bottom of said main column.

11. The emergency escape apparatus of claim 9 in which said disembarkation unit comprises a first tubular structure which merges with said main colum and extends laterally therefrom, a second tubular structure merging into said first tubular structure, a gate switching arrangement means operatively mounted to said first and second tubular structure, said gate switching means consisting of a gate means, a toggle means operating said gate means to alternately close off one of said first and second tubular structures in response to pressure imposed on said gate means by said carrier means.

12. The emergency escape apparatus of claim 1 in which said main column is provided with a fairing means extending longitudinally along both sides of the entire length of said main column.

13. The emergency escape apparatus of claim 1 wherein a plurality of major building bracket assembly means are provided, each of said major building bracket assemblies comprises:

a major building support bracket adapted to be attached to the side of a building;

an upper support member fixedly attached to said main support bracket and having means for supporting an upper modular column section thereto, and further having a notch means adapted to be aligned with said descent channel so as to form a continuous descent channel along said main column; and a lower support member attached to said main support bracket and having means for supporting and aligning a lower modular column section thereto with respect to the upper modular column section.

14. The emergency escape apparatus of claim 13 in which a plurality of base plate means are affixed to each of the lower ends of the mounting of said column sections to said main column support bracket means.

15. The emergency escape apparatus of claim 13 in which a radial thrust bearing means is provided in said main support bracket means to absorb both lateral and longitudinal forces imposed thereon by a column section bearing thereon.

16. The emergency escape apparatus of claim 13 in which a buffer means is located within said notch means in said main support bracket means, whereby said buffer means reduces the vibratory shock in descending between column sections and past said major building bracket assembly means.

17. The emergency escape apparatus of claim 11 in which a braking buffer means is provided within at least one of said main column and first and second tubular structures near the exit point of said main column and first and second tubular structures, operatively engageable with said hook-up unit to brake the descent of said hook-up unit as it nears the exit point.

* * * * *

UNITED STATES PATENT OFFICE
CERTIFICATE OF CORRECTION

PATENT NO. : 3,944,021
DATED : March 16, 1976
INVENTOR(S) : MELVIN F. SMITH,JR. ET AL.

It is certified that error appears in the above-identified patent and that said Letters Patent are hereby corrected as shown below:

Column 12, line 32, "escape" should be --escapee--;

Column 14, line 6, after "the" the word --said-- is omitted;

Column 14, line 9, "of" (second occurrence) should be --for--

Signed and Sealed this

Thirty-first Day of August 1976

[SEAL]

*Attest:*

RUTH C. MASON
*Attesting Officer*

C. MARSHALL DANN
*Commissioner of Patents and Trademarks*